US007621723B2

(12) United States Patent
Okubo

(10) Patent No.: US 7,621,723 B2
(45) Date of Patent: Nov. 24, 2009

(54) ELECTROMAGNETIC PUMP

(75) Inventor: Masashi Okubo, Chiisagata-gun (JP)

(73) Assignee: Shinano Kenshi Kabushiki Kaisha, Nagano (JP)

( * ) Notice: Subject to any disclaimer, the term of this patent is extended or adjusted under 35 U.S.C. 154(b) by 719 days.

(21) Appl. No.: 10/559,747

(22) PCT Filed: Mar. 22, 2004

(86) PCT No.: PCT/JP2004/003882

§ 371 (c)(1),
(2), (4) Date: Dec. 7, 2005

(87) PCT Pub. No.: WO2005/090786

PCT Pub. Date: Sep. 29, 2005

(65) Prior Publication Data

US 2006/0127251 A1 Jun. 15, 2006

(51) Int. Cl.
*F04B 35/04* (2006.01)
*F04B 17/04* (2006.01)

(52) U.S. Cl. ..... 417/418; 417/415; 417/460; 417/526; 417/533; 417/534; 361/699

(58) Field of Classification Search ..... 417/417, 417/526, 533, 415, 418, 460, 534; 361/699
See application file for complete search history.

(56) References Cited

U.S. PATENT DOCUMENTS 4,966,533 A 10/1990 Uchida et al.
5,302,872 A * 4/1994 Ohki et al. ..... 310/12
5,387,090 A 2/1995 Becker
6,568,921 B2 * 5/2003 Dittrich ..... 417/312
6,783,335 B2 * 8/2004 Chang ..... 417/417
6,971,861 B2 * 12/2005 Black et al. ..... 417/440

FOREIGN PATENT DOCUMENTS

JP 54-85404 U 6/1979
JP 64-19189 A 1/1989
JP 1-321854 A 12/1989

(Continued)

*Primary Examiner*—Devon C Kramer
*Assistant Examiner*—Patrick Hamo
(74) *Attorney, Agent, or Firm*—Birch, Stewart, Kolasch, Birch LLP

(57) ABSTRACT

A pump apparatus that produces a pumping action for a gas or a liquid is produced in an extremely small and slim form and can be favorably used as a cooling pump apparatus for an electronic appliance or the like.

There is provided an electromagnetic pump where a plunger 10 including a magnetic body is provided so as to be capable of sliding inside a cylinder that is sealed at both end surfaces thereof by a pair of frames 20*a*, 20*b* with spaces between the plunger 10 and the end surfaces of the respective frames 20*a*, 20*b* as pump chambers 30*a*, 30*b*, air-core electromagnetic coils 50*a*, 50*b* are disposed around an outer circumference of the cylinder, and a fluid is conveyed by passing a current through the electromagnetic coils 50*a*, 50*b* to reciprocally move the plunger 10 in an axial direction of the cylinder, wherein intake valves 34*a*, 34*b* and outflow valves 36*a*, 36*b* that connect the pump chambers 30*a*, 30*b* and the outside are provided inside regions of the frames 20*a*, 20*b* at the end surfaces of the cylinder.

19 Claims, 2 Drawing Sheets

FOREIGN PATENT DOCUMENTS

| | | | |
|---|---|---|---|
| JP | 6-200869 | A | 7/1994 |
| JP | 7-279835 | A | 10/1995 |
| JP | 8-116658 | A | 5/1996 |
| JP | 2505140 | Y2 | 5/1996 |
| JP | 9-291881 | A | 11/1997 |
| JP | 2882748 | B2 | 2/1999 |
| JP | 2003-206868 | A | 7/2003 |
| JP | 2003-239866 | A | 8/2003 |
| JP | 2004-60641 | A | 2/2004 |

* cited by examiner

ELECTROMAGNETIC PUMP

TECHNICAL FIELD

The present invention relates to an electromagnetic pump, and in more detail to a compact electromagnetic pump used to convey a fluid such as a gas or liquid.

BACKGROUND ART

A pumping action can be achieved for a gas or liquid by disposing a piston inside a cylindrical chamber so as to be free to move reciprocally, connecting the cylindrical chamber to the outside via an inlet/outlet valve, and reciprocally moving the piston. As examples of apparatuses that use this kind of pumping action, an apparatus constructed by attaching a magnet to a piston disposed inside a cylinder, disposing an electromagnetic coil around an outside of the cylinder and causing the electromagnetic force of the electromagnetic coil to act upon and reciprocally move the piston (see Japanese Laid-Open Utility Model No. H07-4875) and a pump apparatus where cylinders are constructed as double pipes and are disposed facing one another and joined as two stages (see Japanese Laid-Open Patent Publication No. H06-159232) have been proposed.

Conventional apparatuses where an electromagnetic force acts from outside a cylindrical chamber upon a piston disposed inside the cylindrical chamber to reciprocally drive the piston are constructed so as to produce a pumping action by forming the cylinder in a long slim shape along the axial direction and providing the piston with a comparatively long stroke. Accordingly, when a small and slim pump apparatus is required, such as when a pump apparatus is used to cool a small-scale electronic appliance such as a notebook computer, there has been the problem that it is difficult to make the construction of a conventional pump apparatus compact. The reciprocal movement of the piston also tends to produce vibration and noise when the pump apparatus is driven, which is problematic for electronic appliances and the like where there are demands for reductions in vibration and quiet operation.

The present invention was conceived in view of the problems described above and it is an object of the present invention to provide an electromagnetic pump that can be effectively made smaller and slimmer, that has reduced vibration during operation, and can be favorably installed in electronic appliances and the like.

DISCLOSURE OF THE INVENTION

To achieve the object stated above, an electromagnetic pump is constructed so that a plunger, which includes a magnetic body, is provided so as to be free to slide inside a cylinder that is sealed at both end surfaces thereof by a pair of frames with spaces between the plunger and the end surfaces of the respective frames as pump chambers, air-core electromagnetic coils are disposed around an outer circumference of the cylinder, and a fluid is conveyed by passing a current through the electromagnetic coils to reciprocally move the plunger in an axial direction of the cylinder, wherein intake valves and outflow valves that connect the pump chambers and the outside are provided inside regions of the frames at the end surfaces of the cylinder.

According to the electromagnetic pump according to the present invention, a pump apparatus that produces a pumping action for a gas or a liquid can be produced in an extremely small and slim form and a precise pumping action can be produced, and therefore the electromagnetic pump can be favorably used as a cooling pump apparatus for an electronic appliance or the like.

BEST MODE FOR CARRYING OUT THE INVENTION

Preferred embodiments of the present invention will now be described in detail with reference to the attached drawings.

Figure 1:
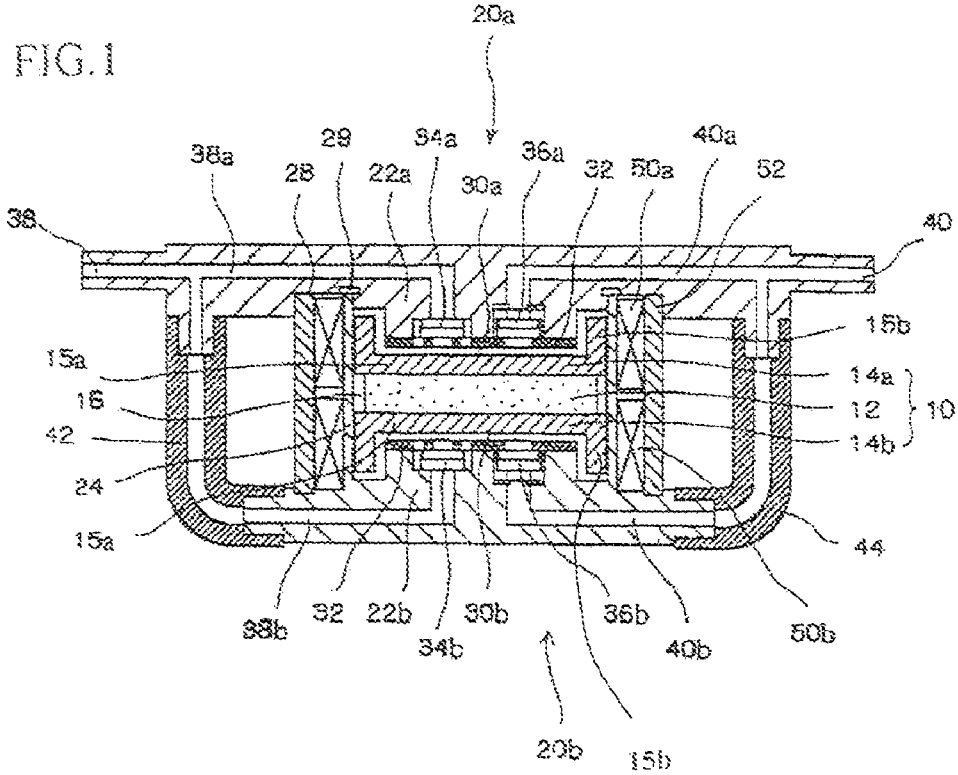
FIG. 1 is a cross-sectional view showing the construction of an electromagnetic pump according to the present invention.

FIG. 1 is a cross-sectional view showing the construction of an electromagnetic pump according to the present invention.

The electromagnetic pump according to the present embodiment is constructed by disposing a plunger, which includes a magnet (a permanent magnet), inside a cylinder in the form of a tube so as to be able to slide in the axial direction of the cylinder and causing the electromagnetic force of an electromagnetic coil disposed around the outside of the cylinder to act upon the plunger, thereby causing the plunger to reciprocally move back and forth and produce a pumping action.

In FIG. 1, reference numeral 10 designates a plunger disposed so as to be able to move reciprocally in the axial direction of the cylinder.

The plunger 10 is composed of a magnet 12 formed in a disc-like shape and a pair of inner yokes 14*a*, 14*b* that sandwich the magnet 12 in the thickness direction. The magnet 12 is a permanent magnet that is magnetized in the thickness direction thereof with a north pole on one surface and a south pole on the other surface. The inner yokes 14*a*, 14*b* are formed of a soft magnetic material and the inner yokes 14*a*, 14*b* respectively include a plate-like portion 15*a* that is formed with a slightly larger diameter than the magnet 12 and a flange portion 15*b* that is in the shape of a short tube erected on a circumferential edge portion of the plate-like portion 15*a*.

Reference numeral 16 designates a sealing member composed of a non-magnetic material such as plastic that covers an outer circumferential surface of the magnet 12. The sealing member 16 prevents an outer portion of the magnet 12 from being exposed and therefore prevents the magnet 12 from rusting, and also combines the magnet 12 and the inner yokes 14*a*, 14*b* into a single body. The sealing member 16 is provided so as to cover the outer circumferential surface of the magnet 12 between the inner yokes 14*a*, 14*b*, but the outer circumferential diameter of the sealing member 16 is formed slightly smaller than the outer circumferential diameter of the inner yokes 14*a*, 14*b*. By forming the sealing member 16 in this way, there is the advantage that when the outer circumferential surfaces of the inner yokes 14*a*, 14*b* are ground as a finishing process, the process can be carried out without the sealing member 16 contacting and damaging the grinding blade, and also the advantage that when the coefficient of thermal expansion of the sealing member 16 is higher than the coefficient of thermal expansion of the inner yokes 14*a*, 14*b*, it is possible to prevent the gap between the plunger 10 and the cylinder narrowing or disappearing when the pump is used at high temperature due to thermal expansion of the sealing member 16, thereby enabling the pump to operate stably.

Figure 2:
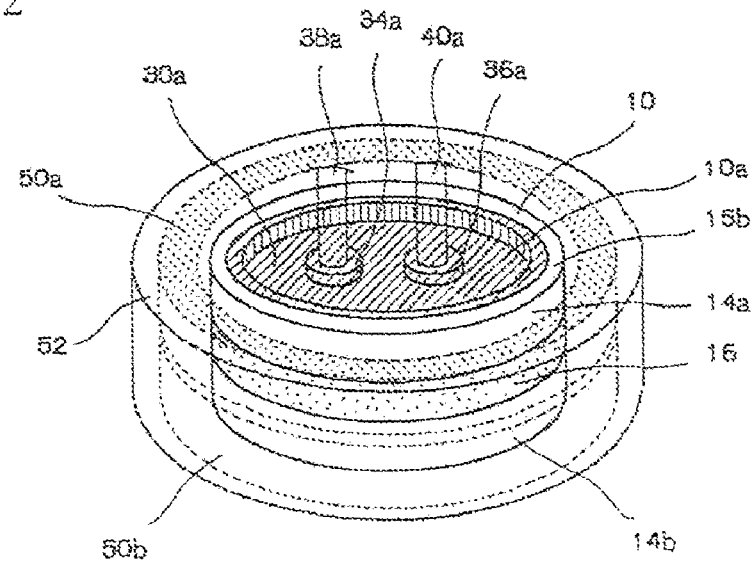
FIG. 2 is a perspective view showing the construction of a plunger of the electromagnetic pump.

FIG. 2 is a perspective view showing a state where the plunger is formed as a cylindrical body by sandwiching the magnet 12 between the inner yokes 14*a*, 14*b* and integrating these components using the sealing member 16. Since the inner yokes 14*a*, 14*b* are formed with the flange portions 15*b* erected on the respective circumferential edge portions thereof, concave parts 10*a* are formed on both end surfaces of the plunger 10 in the axial direction. With the electromagnetic pump according to the present embodiment, by providing the concave parts 10*a* on both end surfaces of the plunger 10, it is possible to form the electromagnetic pump in a slim form, and the reciprocating operation of the plunger 10 can be carried out exactly due to the action of the flange portions 15*b*.

The plunger 10 moves reciprocally inside a cylinder, but in the present embodiment, the plunger 10 is disposed inside a tube-like cylinder formed by assembling a pair of frames.

In FIG. 1, reference numerals 20*a* and 20*b* designate a pair of frames composed of a non-magnetic material that form the cylinder, with 20*a* designating the upper frame and 20*b* designating the lower frame. In the present embodiment, a tube-like portion 24 in a tube-like shape extends from a main body 22*b* of the lower frame 20*b* and an end portion of the tube-like portion 24 engages an engaging groove 28 provided in a main body 22*a* of the upper frame 20*a*, thereby constructing the cylinder that houses the plunger 10. A sealing member 29 is provided at a position where an end surface of the tube-like portion 24 contacts the engaging groove 28 and by pushing the end surface of the tube-like portion 24 against the sealing member 29, the inside of the cylinder is sealed from the outside. It should be noted that it is also possible to have the tube-like portion 24 extend from the upper frame 20*a* and engage the lower frame 20*b*. The tube-like portion 24 may also be formed as a separate component to the upper frame 20*a* and the lower frame 20*b*.

In this way, both end surfaces of the cylinder formed by combining the upper frame 20*a* and the lower frame 20*b* are closed by the main body 22*a* of the upper frame 20*a* and the main body 22*b* of the lower frame 20*b* to form pump chambers 30*a*, 30*b* at the respective end surfaces of the plunger 10.

It should be noted that the plunger 10 slides in contact with the inner surface of the tube-like portion 24 in a state where the gap between the plunger 10 and the tube-like portion 24 is sealed airtight or liquid-tight. To make the plunger 10 slide favorably, a coating with both a lubricating and a rustproofing effect, such as a fluoride resin coating or a DLC (diamond-like carbon) coating, is applied to the outer circumferential surfaces of the inner yokes 14*a*, 14*b*. In addition, a detent that prevents rotation of the plunger 10 in the circumferential direction may also be provided.

The pump chambers 30*a*, 30*b* correspond to gap parts between both end surfaces of the plunger 10 and respectively the main body 22*a* of the upper frame 20*a* and the main body 22*b* of the lower frame 20*b*.

In the present embodiment, the main body 22*a* of the upper frame 20*a* is formed so as to protrude inside the concave part 10*a* formed in one end surface of the plunger 10, and in the same way, the main body 22*b* of the lower frame 20*b* is formed so as to protrude inside the concave part 10*a* formed in the other end surface of the plunger 10, and therefore the pump chambers 30*a*, 30*b* are formed as cavities that are curved in cross-section.

Reference numeral 32 designates dampers attached to the end surfaces of the main bodies 22*a*, 22*b*. The dampers 32 are provided to absorb shocks when the inner yokes 14*a*, 14*b* strike the end surfaces of the main bodies 22*a*, 22*b* at end positions of the range of motion of the plunger 10. It should be noted that the dampers may be provided not on the end surfaces of the main bodies 22*a*, 22*b* but on the end surfaces of the inner yokes 14*a*, 14*b* that strike the main bodies 22*a*, 22*b*.

Reference numeral 34*a* designates an intake valve that is provided inside the main body 22*a* of the upper frame 20*a* so as to pass through to the pump chamber 30*a*, while reference numeral 36*a* designates an outflow valve that is provided inside the main body 22*a* so as to pass through to the pump chamber 30*a*. Reference numeral 34*b* designates an intake valve that is provided inside the main body 22*b* of the lower frame 20*b* so as to pass through to the pump chamber 30*b*, while reference numeral 36*b* designates an outflow valve that is provided inside the main body 22*b* so as to pass through to the pump chamber 30*b*.

In the present embodiment, by providing the intake valves 34*a*, 34*b* and the outflow valves 36*a*, 36*b* inside the main bodies 22*a*, 22*b* that protrude inside the concave parts 10*a* of the plunger 10, the intake valves 34*a*, 34*b* and the outflow valves 36*a*, 36*b* can be housed within the length of the cylinder, and therefore the pump apparatus can be made slimmer.

Reference numerals 38*a*, 38*b* designate intake channels that are provided in the upper frame 20*a* and the lower frame 20*b* and pass through to the intake valves 34*a*, 34*b*. Reference numerals 40*a*, 40*b* designate outflow channels that are provided in the upper frame 20*a* and the lower frame 20*b* and pass through to the outflow valves 36*a*, 36*b*.

Figure 4A:
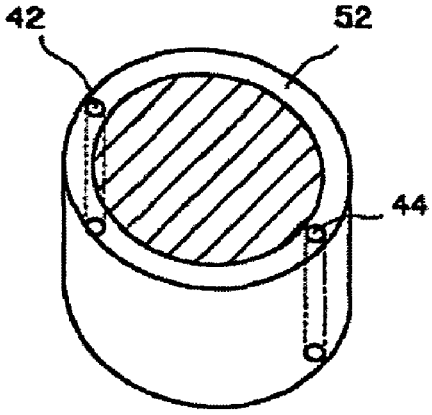
FIGS. 4A and 4B are diagrams useful in explaining examples where through-holes are provided in an outer yoke as connecting pipes.
Figure 4B:
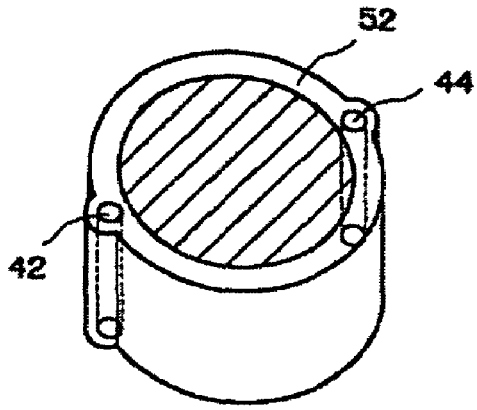

Reference numeral 42 designates a connecting tube that connects the intake channel 38*a* of the upper frame 20*a* and the intake channel 38*b* of the lower frame 20*b* and reference numeral 44 designates a connecting tube that connects the outflow channel 40*a* of the upper frame 20*a* and the outflow channel 40*b* of the lower frame 20*b*. By doing so, the respective intake channels and outflow channels of the upper frame 20*a* and the lower frame 20*b* are connected to a single inlet 38 and a single outlet 40. It should be noted that the connecting tubes 42, 44 may be formed as shown in FIGS. 4A and 4B as through-holes in an outer yoke 52, with the intake channels and the outflow channels being connected via such through-holes.

In FIG. 1, reference numerals 50*a*, 50*b* designate air-core electromagnetic coils that are disposed so as to surround the outer circumference of the tube-like portion 24, that is, the cylinder. The electromagnetic coils 50*a*, 50*b* are disposed slightly apart in the axial direction of the cylinder and at equal positions with respect to a center position in the axial direction. The electromagnetic coils 50*a*, 50*b* are set so that the lengths in the axial direction are longer than the respective ranges of motion of the flange portions 15*b* of the inner yokes 14*a*, 14*b*.

It should be noted that the respective winding directions of the electromagnetic coils 50*a*, 50*b* are opposite directions, and by supplying electricity from a single power source, currents are set so as to flow in opposite directions. The reason that the electromagnetic coils 50*a*, 50*b* are wound in opposite directions is that the forces that act on the currents flowing in the electromagnetic coils 50*a*, 50*b* that are interlinked with the magnetic flux of the magnet 12 are superimposed. These forces act as a reactive force upon the plunger 10 and so produce thrust.

Reference numeral 52 designates an outer yoke that is made of a soft magnetic material, formed in a tube-like shape, and surrounds the outer circumference of the electromagnetic coils 50*a*, 50*b*. By surrounding the outer circumference of the electromagnetic coils 50*a*, 50*b* with the outer yoke 52, the electromagnetic force can be made to effectively act on the plunger 10.

By providing the flange portions 15*b* so as to be erected at the edge portions of the inner yokes 14*a*, 14*b* that construct the plunger 10, resistance in the magnetic circuit of the magnet 12 is reduced, thereby increasing the total magnetic flux generated by the magnet 12. In addition, the magnetic flux generated by the magnet 12 becomes interlinked at right angles to the currents flowing in the electromagnetic coils 50*a*, 50*b* with respect to the axial direction, so that thrust is effectively generated in the axial direction. By using this construction, the mass of the plunger 10 is reduced with respect to the generated thrust, and therefore high-speed response becomes possible and the output flow can also be increased.

When the electromagnetic coils 50*a*, 50*b* and the outer yoke 52 are assembled with the upper frame 20*a* and the lower frame 20*b*, by causing the outer yoke 52 to engage the engaging grooves 28 provided in the upper frame 20*a* and the lower frame 20*b*, the electromagnetic coils 50*a*, 50*b* and the outer yoke 52 can be coaxially attached to the cylinder (the tube-like portion 24). FIG. 2 shows the arrangement of the plunger 10, the electromagnetic coils 50*a*, 50*b* and the outer yoke 52.

By passing an alternating current through the electromagnetic coils 50*a*, 50*b*, the plunger 10 is moved reciprocally (up and down) by the action of the electromagnetic force generated by the electromagnetic coils 50*a*, 50*b*. The electromagnetic force generated by the electromagnetic coils 50*a*, 50*b* presses the plunger 10 in one direction or another according to the direction of the current flowing through the electromagnetic coils 50*a*, 50*b*, and therefore by controlling the current-supplying time and current-supplying direction for the electromagnetic coils 50*a*, 50*b* using a control apparatus, it is possible to reciprocally drive the plunger 10 with an appropriate stroke. By reciprocally moving the plunger 10 so that the end surfaces of the inner yokes 14*a*, 14*b* of the plunger 10 do not strike the end surfaces of the main body 22*a* of the upper frame 20*a* and the main body 22*b* of the lower frame 20*b*, respectively, the generation of vibration by the apparatus can be suppressed. When the plunger 10 does contact the inner surfaces of the main bodies 22*a*, 22*b*, the shock can be absorbed by the action of the dampers 32.

It should be noted that it is also possible to provide a sensor that detects a movement position of the plunger 10 inside the cylinder and to control the reciprocal movement of the plunger 10 based on a detection signal of such sensor. As the method of detecting the movement position of the plunger 10, it is possible to use a method that provides a magnetism detecting sensor that detects the movement position of the plunger 10 outside the cylinder and a method that provides pressure sensors on the dampers 32 and detects the point when the plunger 10 contacts the dampers 32. In the electromagnetic pump according to the present embodiment, the movement stroke of the plunger 10 is comparatively short but the pump chambers 30*a*, 30*b* can be made comparatively wide, and therefore by reciprocally moving the plunger 10 at high speed, a regular amount of flow can be achieved.

With the pumping action of the electromagnetic pump according to the present embodiment, the plunger 10 is caused to move reciprocally by the electromagnetic coils 50*a*, 50*b* so that fluid is taken into and expelled from the pump chambers 30*a*, 30*b* alternately.

That is, when the plunger 10 moves downward in the state shown in FIG. 1, fluid is taken into one of the pump chambers 30*a* and at the same time fluid is expelled from the other pump chamber 30*b*. Conversely, when the plunger 10 moves upward, fluid is expelled from the pump chamber 30*a* and at the same time fluid is taken into the other pump chamber 30*b*. In this way, when the plunger 10 moves to either side, fluid is taken in and expelled, surges in the fluid are suppressed, and fluid can be effectively conveyed.

In the electromagnetic pump according to the present embodiment, the inner yokes 14*a*, 14*b* that have the flange portions 15*b* are attached to the plunger 10 and the intake valves 34*a*, 34*b* and the outflow valves 36*a*, 36*b* are provided near both end surfaces of the plunger 10, and therefore the pump can be provided as a small and extremely slim pump. With the electromagnetic pump according to the present embodiment, it is possible to form a small pump that is around 15 mm high and 20 mm wide.

Figure 3:
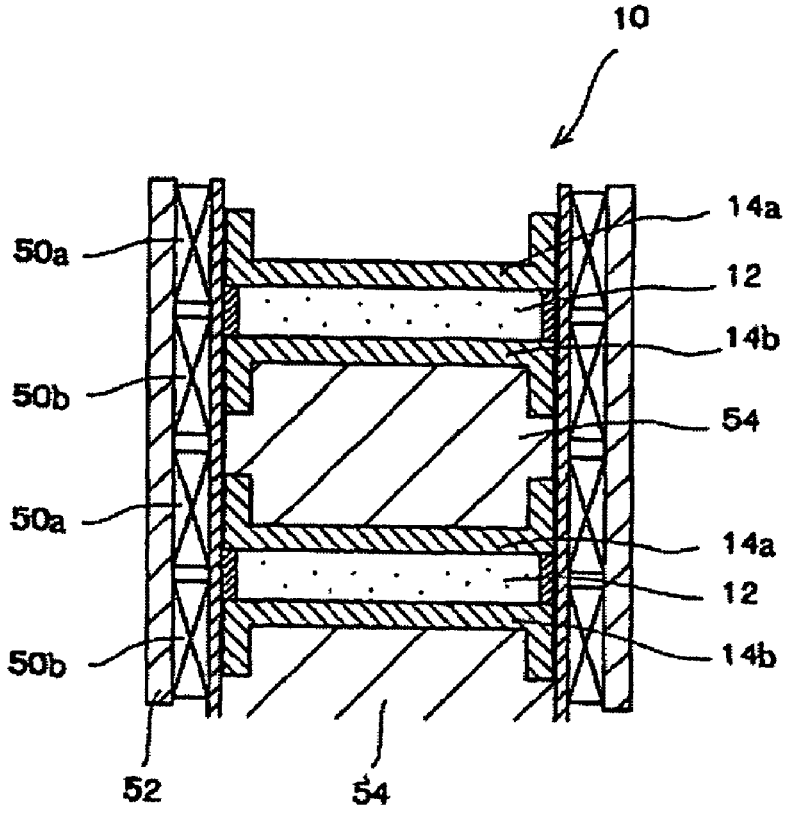
FIG. 3 is a cross-sectional view showing the construction of a plunger with a multistage construction.

The electromagnetic pump according to the present embodiment can be used to convey a gas or liquid, with there being no limit on the type of fluid. When the electromagnetic pump is used as a liquid pump, if the conveying pressure of a single plunger 10 is insufficient, as shown in FIG. 3, a multi-stage plunger 10 where a plurality of unitary plungers of the same shape are respectively composed of a magnet 12 and inner yokes 14*a*, 14*b* may be used. Reference numeral 54 designates a non-magnetic material disposed between the inner yokes 14*a*, 14*b*. The orientations of the magnetic poles of the magnets 12 are aligned in the same direction and electromagnetic coils 50*a*, 50*b* are disposed separately for each unitary plunger with respectively opposite winding directions in the same way as in the embodiment described above. Reference numeral 52 designates the outer yoke provided so as to surround the outer circumferences of all of the electromagnetic coils 50*a*, 50*b*. By connecting unitary plungers in a plurality of stages, it is possible to produce a plunger with large thrust, and therefore an electromagnetic pump with the required conveying pressure can be produced.

It should be noted that in the present embodiment described above, although the flange portions 15*b* are provided on the inner yokes 14*a*, 14*b* attached to the plunger 10, it is also possible to form the inner yokes 14*a*, 14*b* as single plates without providing the flange portions 15*b* on the inner yokes 14*a*, 14*b*. Since the mass of the plunger 10 increases in this case, there is some deterioration in the high-speed response characteristics and producing the pump apparatus in a slim form is somewhat hindered, but the construction is simplified, and therefore it is possible to improve the productivity and reduce the manufacturing cost.

Also, although a construction where the plunger 10 includes the magnet 12 that is sandwiched by the inner yokes 14*a*, 14*b* is used in the present embodiment, the plunger 10 does not always need to be provided with the magnet 12. If the plunger 10 is formed of a magnetic material, when the plunger 10 is displaced toward one of the electromagnetic coils 50*a*, 50*b*, a current can be passed through only that electromagnetic coil to cause the plunger 10 to move in the axial direction, and when the plunger 10 has moved to a position displaced toward the other electromagnetic coil, a current can be passed through the other electromagnetic coil and the supplying of current to the first electromagnetic coil stopped to cause the plunger 10 to move again in the opposite direction. In this way, by performing ON-OFF control of the supplying of current through a pair of electromagnetic coils, it is possible to reciprocally move the plunger 10 in the axial direction.

In addition, although the electromagnetic pump shown in FIG. 1 is an example where the intake channels 38*a*, 38*b* provided on both sides of the plunger 10 are connected and the outflow channels 40*a*, 40*b* provided on both sides of the plunger 10 are connected, or in other words, an example where the channels are connected in parallel, it is possible to use a construction where the channels of a plurality of electromagnetic pumps are connected in series. In this case, the outflow channel 40*a* may be connected to the intake channel 38*b* or the outflow channel 40*b* may be connected to the intake channel 38*a*.

The invention claimed is:

1. An electromagnetic pump where a plunger including a magnetic body is provided so as to be capable of sliding inside a cylinder that is sealed at both end surfaces thereof by a pair of frames with spaces between the plunger and the end surfaces of the respective frames as pump chambers, air-core electromagnetic coils are disposed around an outer circumference of the cylinder, and a fluid is conveyed by passing a current through the electromagnetic coils to reciprocally move the plunger in an axial direction of the cylinder, wherein intake valves and outflow valves that connect the pump chambers and the outside are provided inside regions of the frames at the end surfaces of the cylinder, wherein the plunger is formed by sandwiching a magnet that is formed into a circular disk-like shape and magnetized in the thickness direction between a pair of inner yokes, and wherein flange portions that are shaped as short tubes and are in sliding contact with an inner surface of the cylinder at positions facing the electromagnetic coils are provided on edge portions of plate-like portions of the inner yokes that sandwich the magnet.

2. An electromagnetic pump according to claim 1, wherein the frames are composed of non-magnetic bodies.

3. An electromagnetic pump according to claim 1, wherein the plunger includes a plurality of unitary plungers formed by sandwiching a magnet that is magnetized in the axial direction of the cylinder between a pair of inner yokes, the unitary plungers being connected in the axial direction via non-magnetic members.

4. An electromagnetic pump according to claim 1, wherein an outer circumferential surface of the magnet sandwiched by the inner yokes is sealed by a sealing member made of a non-magnetic material.

5. An electromagnetic pump according to claim 3, wherein an outer circumferential surface of each magnet sandwiched by the inner yokes is sealed by a sealing member made of a non-magnetic material.

6. An electromagnetic pump according to claim 1, wherein an outer circumferential surface of each magnet sandwiched by the inner yokes is sealed by a sealing member made of a non-magnetic material.

7. An electromagnetic pump according to claim 6, wherein an outer circumferential diameter of each sealing member is formed smaller than an outer circumferential diameter of the inner yokes.

8. An electromagnetic pump according to claim 1, wherein the intake valves and the outflow valves are disposed inside concave parts formed inside respective flange portions of the inner yokes.

9. An electromagnetic pump according to claim 1, wherein the intake valves and the outflow valves are disposed inside concave parts formed inside respective flange portions of the inner yokes.

10. An electromagnetic pump according to claim 1, wherein an outer yolk composed of a soft magnetic material that surrounds the air-core electromagnetic coils is provided around an outer circumference of the air-core electromagnetic coils.

11. An electromagnetic pump according to claim 1, wherein a length of the electromagnetic coils in the axial direction of the cylinder is longer than a movable range of the inner yolks inside the pump chamber.

12. An electromagnetic pump according to claim 1, wherein dampers that ease shocks that occur when the plunger contacts the end surfaces of the frames are provided on the end surfaces of the frames.

13. An electromagnetic pump according to claim 1, wherein dampers that ease shocks that occur when the plunger contacts the end surfaces of the frames are provided on surfaces of the plunger that face the end surfaces of the frames.

14. An electromagnetic pump according to claim 1, wherein the intake channel of the pump chamber provided on one surface side of the plunger is connected to the intake channel of a pump chamber provided on another surface side of the plunger and the outflow channel of a pump chamber provided on the one surface side of the plunger is connected to the outflow channel of a pump chamber provided on the other surface side of the plunger.

15. An electromagnetic pump according to claim 1, wherein the intake channel provided on one surface side of the plunger is connected to the outflow channel provided on another surface side.

16. An electromagnetic pump according to claim 1, wherein a sensor that detects a movement position of the plunger is provided and driving of the plunger is controlled based on a detection signal of the sensor.

17. An electromagnetic pump which comprises an upper frame and a lower frame which are constructed to define a sealed chamber therebetween, a plunger containing a magnet sandwiched between a pair of inner yokes which are provided at their edge portions with flanges which extend away from the inner yokes on opposite sides of the magnet to define recessed areas, said plunger being slidably disposed within said sealant chamber while defining pump chambers on each side of the plunger between the upper and lower frames and the respective end surfaces of the inner yokes and flanges, intake valves and out flow valves operatively communicating with the respective pump chambers in said recessed areas to provide communication between the pump chambers and the outside environment, and air-core electromagnetic coils disposed around the sealed chamber and means for passing a current through the electromagnetic coils to reciprocally move the plunger within the sealed chamber for conveying a fluid through said intake and outflow valves.

18. The electromagnetic pump of claim 17, wherein said pump has a circular configuration and the magnet has a circular, disk-like shape and magnetized in the thickness direction thereof.

19. The electromagnetic pump of claim 17, wherein the end portions of the flanges are in sliding contact with the inner surface of the pump chambers.

* * * * *